US008414679B2

(12) United States Patent
Schiefer et al.

(10) Patent No.: US 8,414,679 B2
(45) Date of Patent: Apr. 9, 2013

(54) PRODUCING AN ALLOY WITH A POWDER METALLURGICAL PRE-MATERIAL

(75) Inventors: Herwig Schiefer, Frankfurt (DE); Christoph Vogt, St. Paul, MN (US); Heiko Specht, Hanau (DE); Jens Troetzschel, Hanau (DE)

(73) Assignee: W. C. Heraeus GmbH, Hanau (DE)

( * ) Notice: Subject to any disclaimer, the term of this patent is extended or adjusted under 35 U.S.C. 154(b) by 243 days.

(21) Appl. No.: 12/851,892

(22) Filed: Aug. 6, 2010

(65) Prior Publication Data

US 2011/0033335 A1 Feb. 10, 2011

(30) Foreign Application Priority Data

Aug. 6, 2009 (DE) ..... 10 2009 036 298

(51) Int. Cl.
*C22C 1/02* (2006.01)
*C22C 1/04* (2006.01)

(52) U.S. Cl. ..... 75/751; 75/770; 420/590; 419/33

(58) Field of Classification Search ..... 75/770, 75/751; 420/590; 419/33
See application file for complete search history.

(56) References Cited

U.S. PATENT DOCUMENTS

| | | | | |
|---|---|---|---|---|
| 3,592,637 | A | 7/1971 | Brown et al. | |
| 5,374,295 | A * | 12/1994 | Miura et al. | 75/244 |
| 2006/0153729 | A1 | 7/2006 | Stinson et al. | |
| 2010/0168841 | A1* | 7/2010 | Furst et al. | 623/1.42 |
| 2011/0129386 | A1* | 6/2011 | Schiefer et al. | 420/580 |
| 2011/0264161 | A1* | 10/2011 | Schiefer et al. | 607/36 |

FOREIGN PATENT DOCUMENTS

| | | | |
|---|---|---|---|
| DE | C 5588 VI | | 8/1956 |
| DE | 691 26 973 | | 11/1991 |
| EP | 0801138 | | 10/1997 |
| EP | 1444993 | | 11/2004 |
| JP | 59035642 | A * | 2/1984 |
| WO | 9118121 | | 11/1991 |
| WO | 2009079282 | | 6/2009 |

OTHER PUBLICATIONS

"Periodic Table: Melting Point" at http://www.chemicalelements.com/index.html. created by Yinon Bentor. Copyright 1996-2009. Downloaded May 31, 2012.*
English translation of JP 59-035642 by Fukazawa et al. published Feb. 27, 1984.*
O'Brien, Barry et al., "Development of a New Niobium-Based Alloy for Vascular Stent Applications," Journal of the Mechanical Behavior of Biomedical Materials I, pp. 303-312 (2008).
The Restriction Requirement for U.S. Appl. No. 12/959,031 mailed May 16, 2012 (6 pages).
The Office Action for U.S. Appl. No. 12/959,031 mailed Jul. 17, 2012 (14 pages).

* cited by examiner

*Primary Examiner* — George Wyszomierski
*Assistant Examiner* — Tima M McGuthry Banks
(74) *Attorney, Agent, or Firm* — Dicke, Billig & Czaja, PLLC

(57) ABSTRACT

One aspect is a method for producing an alloy, whereby the alloy includes at least a first metal and a second metal, whereby firstly a powder metallurgical route and subsequently a melt metallurgical route is used sequentially in order to generate the alloy from the, at least, first metal and the second metal. The method includes grinding the first metal into a first metal powder, grinding the second metal into a second metal powder, mixing the first metal powder and the second metal powder to produce a blended powder, generating a blended body from the blended powder by the powder metallurgical route, and generating the alloy by melting the blended body by the melt metallurgical route.

16 Claims, 5 Drawing Sheets

PRODUCING AN ALLOY WITH A POWDER METALLURGICAL PRE-MATERIAL

CROSS-REFERENCE TO RELATED APPLICATIONS

This Utility Patent Application claims priority to German Patent Application No. DE 10 2009 036 298.3, filed on Aug. 6, 2009, which is incorporated herein by reference.

BACKGROUND

One aspect relates to a method for producing an alloy.

Wires are needed in medical technology for producing medical components. Said wires are made, for example, of alloys made of multiple high-melting metals. In known production methods, rods made of pure metal are bundled and melted in a high vacuum, for example, by means of an electron beam. It has proven to be disadvantageous that, in alloys that include metals such as tantalum, niobium, and tungsten, the element with the highest melting point is melted only incompletely. In some cases, larger lumps, for example, tungsten, drop into the melt bath without mixing with the other components of the alloy. Said non-melted lumps of one of the alloy metals, called inclusions, later lead to failure of the material when the alloy material is drawn out into a wire. Fissures or cavities may thus form at the inclusions. Moreover, the inclusions render the processing more difficult. The inclusions reduce the fatigue resistance and lead to corrosion of a wire made of said alloy.

For these and other reasons there is a need for the present invention.

SUMMARY

One aspect is a method for producing an alloy. The alloy includes at least a first metal and a second metal, and grinding the first metal into a first metal powder and grinding the second metal into a second metal powder. The first metal powder and the second metal powder are mixed to produce a blended powder. A blended body is generated from the blended powder by the powder metallurgical route. The alloy is generated by melting the blended body by the melt metallurgical route.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

Figure 1:
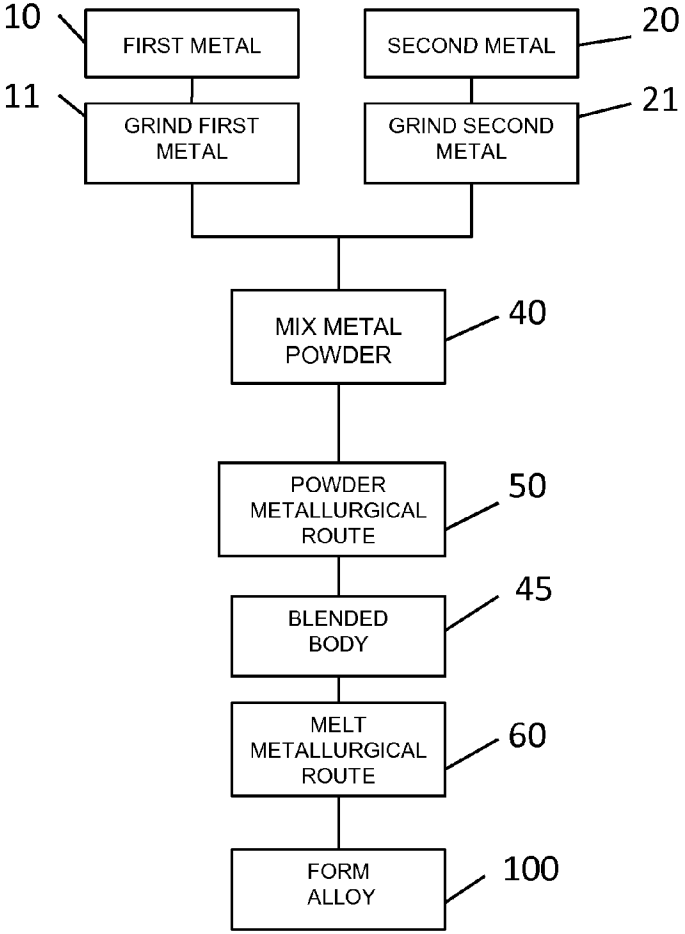
FIG. 1 illustrates a flow diagram of a method according to one embodiment.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

One aspect provides a method for producing an alloy, in which the above-mentioned disadvantages are avoided, in particular to provide a method that reduces the maximal size of the inclusions as compared to known methods. Accordingly, one embodiment is a method for producing an alloy and one embodiment is an alloy having various features. In this context, any features and details that are described in relation to the method shall also apply in relation to the alloy and vice versa.

One aspect discloses a method for producing an alloy, whereby the alloy includes at least a first metal and a second metal, whereby firstly a powder metallurgical route and subsequently a melt metallurgical route is used sequentially in order to generate the alloy from the, at least, first metal and second metal, and the method includes the steps of a) grinding the first metal into a first metal powder;

b) grinding the second metal into a second metal powder;

c) mixing the first metal powder and the second metal powder to produce a blended powder;

d) generating a blended body from the blended powder by the powder metallurgical route;

e) generating the alloy by melting the blended body by the melt metallurgical route.

One embodiment is based on combining two methods for producing an alloy. This allows the advantages of the powder metallurgical route and of the melt metallurgical route to be combined. Performing the two routes—powder metallurgical and melt metallurgical—to be illustrated in more detail below, sequentially results in alloys whose inclusions are less than 10 μm in size. In the context of one embodiment, inclusion shall mean a region in the alloy that includes only one of the various metals of the alloy. This single-element region consists of only one metal of the alloy and contacts the other metals of the alloy only on its outside surfaces. The advantages of the powder metallurgical route in one embodiment, is that it allows good homogenization and easy alloying to be achieved at low sintering temperatures. In one embodiment, these advantages are combined with the advantages of the melt metallurgical route, that is, the high level of purity of the alloy that can be achieved and the feasibility of alloying high-melting metals together.

In the context of one embodiment, the term, "powder metallurgical route", denotes a manufacturing process, in which a metal object is manufactured from a metal powder. The term, "powder metallurgical route", includes the following manufacturing processes: hot pressing, sintering, hot isostatic pressing. Hot pressing involves shaping and compacting a metal powder into a metal object by exposure to a—in particular uniaxial—pressure and temperature. Sintering involves a heat treatment, in which an object consisting of metal powder is compacted. In hot isostatic pressing (HIP), a metal powder that has been filled into a mold is compacted into a metal object with approximately 100% density (isostatic) by means of high pressure and high temperature.

Because of the high affinity for oxygen, it has proven to be advantageous in one embodiment to melt refractory metals under vacuum conditions. This allows pre-existing impurities to be removed and gas inclusions in metals to be prevented. In the context of one embodiment, the term, "melt metallurgical route", means a manufacturing process, in which a metal object is melted by exposure to an energy source in a vacuum. The term, "melt metallurgical route", includes, for example, the following manufacturing processes: vacuum induction, electron beam melting, and arc melting. In vacuum induction, the metal object to be melted is melted in a crucible by means of induction under vacuum conditions and then poured into a water-cooled crucible. In electron beam melting, energy-rich electron beams are used under vacuum conditions to melt high-melting materials, which are then poured into an ingot mold with a floor, which can be lowered, and cooled walls. In arc melting, an arc is ignited between the metal object to be melted and an electrode by means of a high voltage and under vacuum conditions, which causes the material to melt.

One embodiment of one method is characterized in that the alloy includes at least a third metal. Alloys that are used in the area of medical technology are often generated from high-melting metals. Alloys of this type commonly include more than only two metals. The method according to one embodiment has proven to be well-suited for producing a tantalum-niobium-tungsten alloy (TaNbW alloy containing 10 wt. % Nb and 7.5 wt. % W). With regard to the nomenclature of the patent claim, tungsten therein functions as first metal, tantalum as second metal, and niobium as third metal. In this context, tantalum and tungsten are generated as a pre-alloy by the powder metallurgical and melt metallurgical routes. The third metal—in general residues of tantalum and niobium—is added to the two first metals according to the procedural steps to be described below.

One development of the method according to one embodiment is characterized by i. grinding the third metal into a third metal powder; and ii. mixing the third metal powder with the blended powder in step c).

In this embodiment of the method, the third metal is ground into a third metal powder. The first, second, and third metal powder are mixed to form a blended powder, in which the weight fractions of the three metal powders correspond to the alloying ratio desired later on. This embodiment of the method is advantageous in that it is easy to perform. All it requires is grinding the three metal powders. In the process, the size of the metal powder into which the metal is ground determines the size of the inclusions in the finished alloy. The grinding size that has proven to be advantageous in one embodiment is illustrated in more detail below.

Another development of the method according to one embodiment is characterized by i. grinding the third metal into a third metal powder;

ii. generating an additional body from the third metal powder by the powder metallurgical route;

and by the alloy being generated in step e) by parallel melting of the blended body and the additional body by the melt metallurgical route. As before, in this embodiment of the method, the third metal is ground into a metal powder. Deviating from the embodiment described above, the third metal powder is not admixed to the blended powder, though. Rather, an additional body is generated from the third metal powder by the powder metallurgical route. Accordingly, for example, the third metal powder can be pressed to form the additional body and hardened by a heat treatment. In the subsequent step e), the blended body made of the first two metals and the additional body are then melted jointly by the melt metallurgical route. This can be effected, for example, by bombardment with electrons in electron beam melting. In the process, the melted particles of the blended body and the additional body flow into a water-cooled ingot mold and solidify therein as an alloy. In this embodiment of the melt metallurgical route, the blended body and the additional body are arranged next to each other such that both are hit by the electron beam and are thus melted in parallel. Said parallel performance of the melt metallurgical route ensures that melted particles of all three metals flow into the ingot mold and solidify therein as a homogeneous alloy whose inclusions are less than 10 μm in size. Said alloys can then be used for medically implantable devices. In the scope of the variant of the method according to one embodiment described here, the third metal powder can just as well be compacted by hot isostatic pressing (HIP). Subsequently, the HIP body is cut into oblong bars which are melted jointly with the blended body and combined into an alloy by the melt metallurgical route.

Another development of the method according to one embodiment is characterized in that the alloy is generated in step e) by means of parallel melting of the blended body and a body made of the third metal by the melt metallurgical route. In the scope of said embodiment of the method, the third metal is subjected neither to powder metallurgical, nor to melt metallurgical pre-processing. Rather, a body made of the third metal is processed together with the blended body by the melt metallurgical route. There is no processing of the body made of the third metal involved before it is melted by the melt metallurgical route. The body made of the third metal can be a bar or a rod that includes the third metal in pure form. Said body is bundled with the blended body at a ratio that corresponds to the later ratio of the metals in the alloy. Thereafter follows the melting of the body and blended body by the melt metallurgical route.

In order to attain particular purity of the alloy and to further reduce the size of any inclusions, it has proven to be advantageous in one embodiment to supplement the method in that the method includes after step d) the step of f) melting the alloy by the melt metallurgical route.

In the scope of procedural step f), the alloy generated in step e) is melted again. After the alloy generated in step e) has solidified, it can be melted again by the melt metallurgical route. Accordingly, it is conceivable, for example, to melt the alloy from step e) in a vacuum using an electron beam. Any inclusions, which already are less than 10 μm in size, can be further reduced in size by the repeated melting. A further advantageous development of said embodiment provides for step f) to be performed multiply. Accordingly, it has proven to be advantageous in one embodiment to perform step f) two to ten times, in particular three to five times. Repeated melting of the alloy by the melt metallurgical route further reduces the size of the inclusions. Accordingly, it was possible to realize inclusion sizes between 4 μm and 10 nm in particular by means of melting three to five times in the scope of step f). Alloys with inclusions of this size can be used, in particular, for medically implantable objects to particular advantage in some embodiments. Inclusions of this size do not reduce the fatigue resistance of the finished product.

Another development of the method according to one embodiment is characterized in that the first metal is ground into a first metal powder with a first powder particle size of between 10 μm and 0.1 μm and/or the second metal is ground into a second metal powder with a second powder particle size of between 10 μm and 0.1 μm. The first and the second metal each are ground into metal powder according to the method. Depending on the development of one embodiment, the third metal also can be ground into a third metal powder. In order to ensure that the inclusions, that is, those regions inside the alloy, in which only a single metal is present in elemental form, are small in size, the metals must be ground fine enough during the preparation phase for the powder particle size of the individual metal powders to be between 10 μm and 0.1 μm, since the size of the powder particles is correlated to the size of the inclusions. In the context of one embodiment, the term, "powder particle size", is used to refer to the maximal size of those particles of the metal powder that is achieved within the scope of grinding and ensuing screening. Accordingly, the size of the mesh of the sieve used to screen the metal powder after grinding indicates the upper limit of the powder particle size. According to one embodiment, the required powder particle size shall specify the maximal size of a particle of the metal powder. No particle of the metal powder shall be of a size larger than the powder particle size, but can be of any smaller size.

Due to the grinding of the first metal and second metal, and in one embodiment, of the third metal also, the size of the inclusions of the first and/or second and/or third metal in the alloy is between 10 μm and 10 nm. If, in addition, step f) according to one embodiment is performed multiply, it is feasible according to one embodiment for the size of the inclusions to be between 4 μm and 20 nm. Said size is non-objectionable for the use in alloys of medically implantable devices.

Another development of the method according to one embodiment is characterized in that the first metal and the second metal have different melting temperatures, in particular in that the first metal and/or the second metal have a higher melting temperature than the third metal. Especially in the case of high-melting metals, in particular refractory metals, the disadvantages specified above can occur during known melting methods. Since metals of this type are used in medicine due to their good biocompatibility, the method according to one embodiment lends itself to the production of alloys for medical instruments and objects. In this context, it is advantageous in one embodiment for the first metal and/or the second metal and/or the third metal to be formed from the group consisting of the elements, Pt, Pd, Ag, Au, Nb, Ta, Ti, Zr, W, V, Hf, Mo, Co, Cr, Ni, Ir, Re, Ru.

The scope of one embodiment also includes disclosure of an alloy made of at least a first metal and a second metal, characterized in that the alloy is generated according to any one of the methods described above.

The technical issue, on which the method according to one embodiment for producing an alloy is based, is that not all metals are distributed homogeneously in the finished alloy, in particular in the case of high-melting refractory metals, but rather regions—also called inclusions—are formed, in each of which only one metal of the various metals used for the alloy is present in pure form. Inclusions of this type can significantly reduce the fatigue resistance of the finished product. In order to overcome this disadvantage, one embodiment discloses a method for producing an alloy, in one embodiment, made of refractory metals, whereby the alloy 100 includes at least a first metal 10 and a second metal 20. In this context, alloy 100 shall be understood to be a fusion of said two metals 10, 20 into a combination metal. The special feature according to one embodiment is that first a powder metallurgical route and subsequently a melt metallurgical route are used sequentially, that is, one after the other, for producing the alloy.

FIG. 1 illustrates a flow diagram of the method according to one embodiment for producing the alloy 100. The method is based on the use of the first metal 10 and the second metal 20. Firstly, the first metal 10 is ground into a first metal powder 11. In parallel or subsequently, the second metal 20 is ground into a second metal powder 21. In this context, it has proven to be advantageous in one embodiment for the first metal 10 to be ground into a first metal powder 11 with a particle size of between 10 μm and 0.1 μm. The same applies to the second metal that is ground into a second metal powder 21. Subsequently, the first metal powder 11 and the second metal powder 21 are mixed to form a blended powder 40. Said blended powder 40 includes the first metal powder 11 and the second metal powder 21 in a distribution that corresponds to the one which the two metals 10, 20 are to possess later in the alloy 100. The blended powder 40 is used to generate a blended body 45 by the powder metallurgical route 50. The powder metallurgical route 50 can, for example, be a process of hot isostatic pressing (HIP). In the process, the blended powder 40 is compacted into the blended body 45 by the influence of pressure and heat. Subsequently, the blended body 45 can be cut into oblong bars, which are then melted by the melt metallurgical route 60 in order to form the alloy 100.

In the context of one embodiment, the powder metallurgical route, in particular, refers to the manufacturing of a product using the following steps, whereby each step can take a different form:

1) generation of a metal powder 11, 21,
2) shaping, and
3) heat treatment.

For manufacturing an alloy 100 by means of the powder metallurgical route 50, metal powders 10, 20 of pure metals or alloys in powder particle sizes are needed. The type of powder production has a major impact on the properties of the powders. Mechanical methods, chemical reduction methods or electrolytic methods as well as the carbonyl method, spinning, atomizing, and other methods can be used for producing the powder. The shaping involves compaction of the metal powder in pressing tools under high pressure (between 1 and 10 t/cm$^2$ (tonnes per square centimeter) to form green compacts. Other possible methods include compaction by vibration, slip casting method, and methods involving the addition of binding agents. In heat treatment (also called sintering), the powder particles are solidly connected at their contact surfaces by diffusion of the metal atoms. The sintering temperature of single-phase powders is between 65 and 80% of the solidus temperature.

In another development, the alloy includes at least a third metal 30. In order to integrate said third metal into the alloy such that as little inclusions as possible form, the method according to one embodiment can be supplemented by further procedural steps. The sequence thereof is illustrated in FIGS. 2 to 4.

Figure 2:
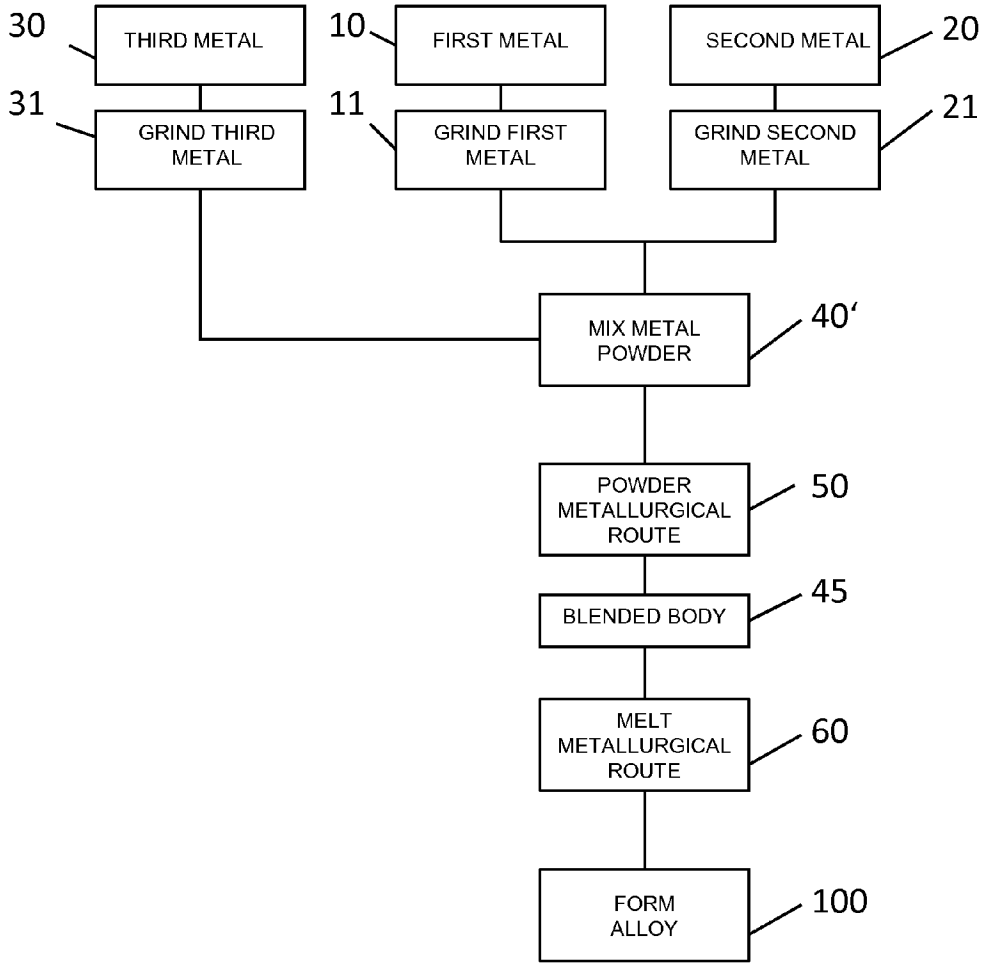
FIG. 2 illustrates a flow diagram of a first development of the method according to one embodiment.

FIG. 2 illustrates a method according to one embodiment. Paralleling the grinding of the first metal 10 and second metal 20, the third metal 30 is ground into a third metal powder 31. Said third metal powder 31 is eventually introduced into the blended powder 40'. Accordingly, the three metals 10, 20, 30 are present in the metal powder 40' in the form of powders and in weight ratios as are desired to be present later in the alloy 100. The subsequent steps correspond to those procedural steps that were also illustrated in FIG. 1. Accordingly, a blended body 45 is generated from the blended powder 40' by the powder metallurgical route 50. Said blended body 45 is then melted by the melt metallurgical route in order to obtain the alloy 100.

Figure 3:
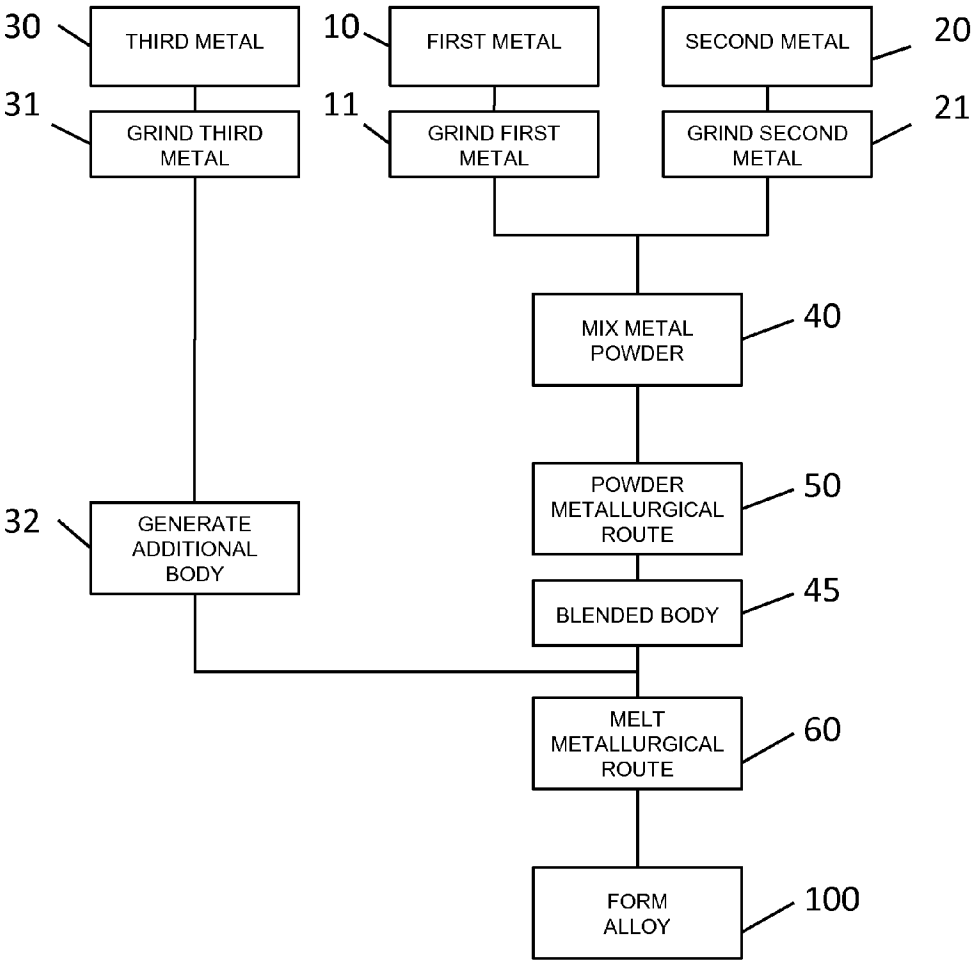
FIG. 3 illustrates another development of the method according to one embodiment.
Figure 4:
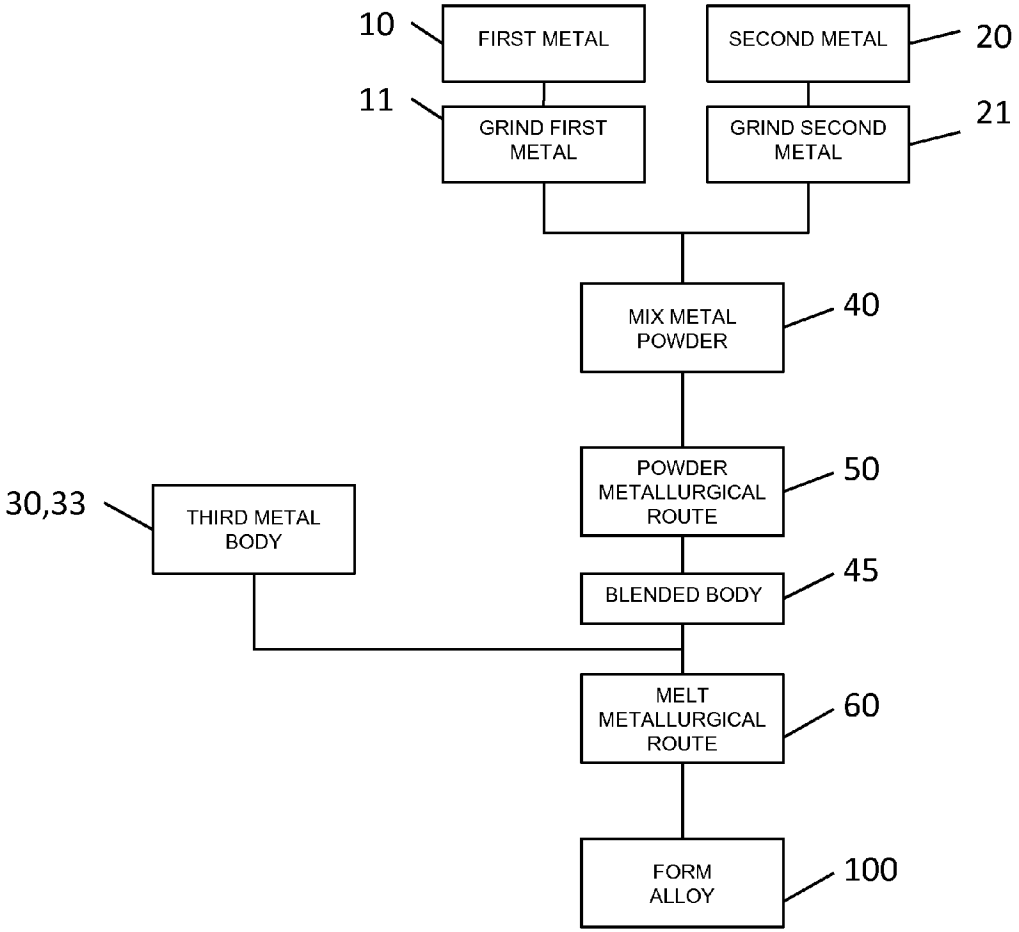
FIG. 4 illustrates a flow diagram of another embodiment of the method according to one embodiment.

Alternatively, the third metal 30 can be introduced into the alloy 100 by a different route, such as is illustrated in FIG. 3. Although the third metal 30 is ground into a metal powder 31 herein as well, said third metal powder 31 is not added to the blended powder 40'. Rather, the third metal powder 31 is used to generate an additional body 32 by the powder metallurgical route. Said additional body 32 can be generated, for example, by hot isostatic pressing, and subsequently be shaped into an oblong bar. Subsequently, the blended body 45 and the additional body 32 are melted in parallel by the melt metallurgical route 60. By jointly embarking on the melt metallurgical route 60, the alloy 100 is produced from the blended body 45 and the additional body 32.

In another alternative development of the method according to one embodiment, the third metal 30, in one embodiment in pure form, is provided in the form of a body 33. Said body 33 can, for example, be a bar made of the third metal 30. Said bar is melted jointly with the blended body 45, which was generated by the powder metallurgical route, using the melt metallurgical route 60. Thus a joint alloy 100 is formed. The individual procedural steps are illustrated in FIG. 4.

Figure 5:
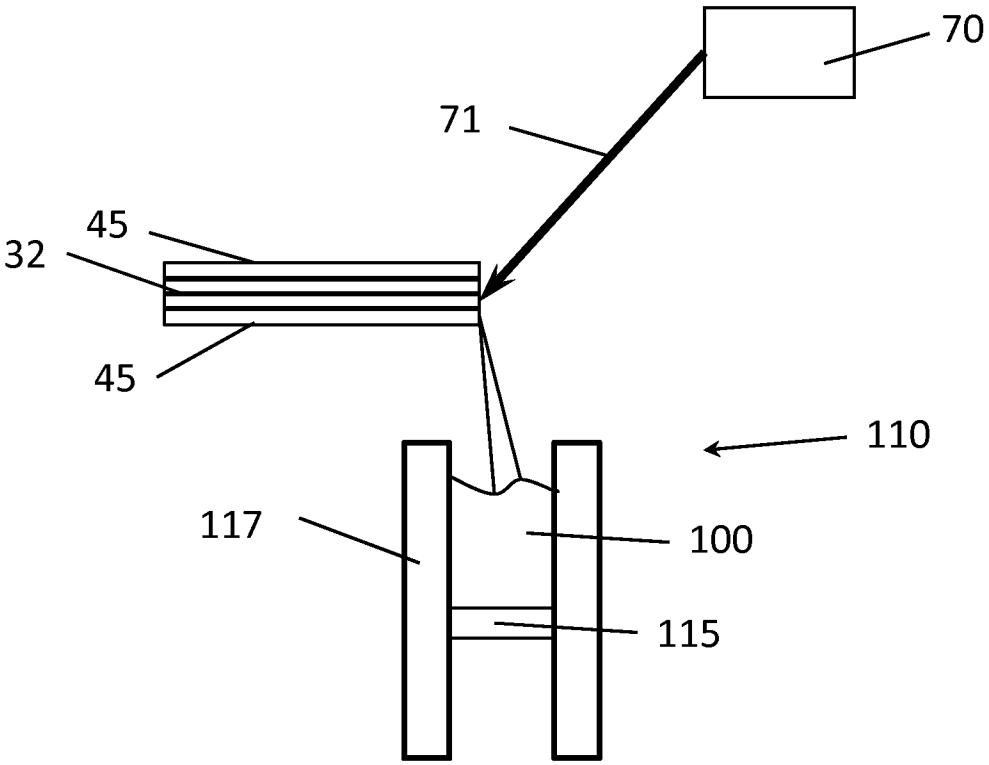
FIG. 5 illustrates a schematic view of a melt metallurgical processing within the scope of the method according to one embodiment.

FIG. 5 illustrates the melt metallurgical route 60 by means of an electron beam melting process. As explained above, the third metal 30 can be ground into a third metal powder 31 and an additional body 32 can be generated by the powder metallurgical route 50. Subsequently, said additional body 32 is spatially arranged next to the blended body 45 in a vacuum chamber. An electron beam source 70 generates an electron beam 71 that knocks individual metal particles out of the blended body 45 or the additional body 32. Said metal particles surprisingly are of a size that is identical to a powder particle size of the corresponding metal powder, 11, 21, 31 of the available metals 10, 20, 30, respectively. Accordingly, the first metal 10 and second metal 20 should be ground to a powder particle size of between 10 μm and 0.1 μm in order for inclusions of the first metal 10 and/or the second metal 20 in the alloy 100 to be between 10 μm and 10 nm in size. The melted metal particles flow into the ingot mold 110 and form the alloy 100 therein. For the alloy 100 to solidify readily, the walls 117 of the ingot mold are cooled. A floor 115 that can be lowered ensures that the path to be traveled by the melted metal particles until they hit the surface of alloy 100 is always the same.

A development of the method according to one embodiment provides the alloy 100 to be melted again subsequent to step d) by the melt metallurgical route 60. Multiple melting of the alloy 100 by the melt metallurgical route 60 allows the size of the inclusions of the first metal 10 and/or the second metal 20 and/or the third metal 30 in the alloy to be reduced further. It has proven to be advantageous in one embodiment to melt the generated alloy three to five times by melt metallurgical means. In the process, it is feasible to attain inclusions of the first metal 10 and/or the second metal 20 and/or the third metal 30 whose size is between 4 μm and 20 nm. Inclusions of this type no longer have an impact on the fatigue resistance of the alloy in implantable medical devices.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method for producing an alloy, whereby the alloy includes at least a first metal and a second metal, whereby firstly a powder metallurgical route and subsequently a melt metallurgical route is used sequentially in order to generate the alloy from the, at least, first metal and the second metal, the method comprising:

grinding the first metal into a first metal powder;

grinding the second metal into a second metal powder;

mixing the first metal powder and the second metal powder to produce a blended powder;

generating a blended body from the blended powder by the powder metallurgical route; and generating the alloy by melting the blended body by the melt metallurgical route.

characterized in that inclusions of at least one of the first metal and the second metal in the alloy are between 4 μm and 20 nm in size.

2. The method according to claim 1, characterized in that the alloy includes at least a third metal.

3. The method according to claim 2, characterized by:

grinding the third metal into a third metal powder; and mixing the third metal powder with the blended powder.

4. The method according to claim 2, characterized by:

grinding the third metal into a third metal powder;

generating an additional body from the third metal powder by the powder metallurgical route; and by the alloy being generated by parallel melting of the blended body and the additional body by the melt metallurgical route.

5. The method according to claim 2, characterized by the alloy being generated by parallel melting of the blended body and a body made of the third metal by the melt metallurgical route.

6. The method according to claim 2, characterized in that the first metal and/or the second metal have a higher melting temperature than the third metal.

7. The method according to claim 2, characterized in that at least one of the first metal, the second metal, and the third metal is formed from a group consisting of the elements, Pt, Pd, Ag, Au, Nb, Ta, Ti, Zr, W, V, Hf, Mo, Co, Cr, Ni, Ir, Re, and Ru.

8. The method according to claim 1, characterized in that melting the alloy is performed multiple times.

9. The method according to claim 1, characterized in that the first metal is ground into the first metal powder with a first powder particle size of between 10 μm and 0.1 μm and/or the second metal is ground into the second metal powder with a second powder particle size of between 10 μm and 0.1 μm.

10. The method according to claim 1, characterized in that the first metal and the second metal have different melting temperatures.

11. A method for producing an alloy comprising:

grinding a first metal into a first metal powder;

grinding a second metal into a second metal powder;

mixing the first metal powder and the second metal powder to produce a blended powder;

generating a blended body from the blended powder by a powder metallurgical route; and generating the alloy by melting the blended body by a melt metallurgical route;

characterized in that inclusions of at least one of the first metal and the second metal in the alloy are between 10 μm and 10 nm in size.

12. The method according to claim 11, characterized in that the powder metallurgical route comprises manufacturing a metal object from a metal powder, and is a process from a group comprising hot pressing, sintering, and hot isostatic pressing.

13. The method according to claim 11, characterized in that the melt metallurgical route comprises manufacturing a metal object that is melted by exposure to an energy source in a vacuum and is a process from a group comprising vacuum induction, electron beam melting, and arc melting.

14. The method according to claim 11, characterized in that the alloy includes at least a third metal, and further comprising grinding the third metal into a third metal powder, and mixing the third metal powder with the blended powder.

15. The method according to claim 14, characterized in that at least of the first metal, the second metal, and the third metal is formed from a group consisting of the elements, Pt, Pd, Ag, Au, Nb, Ta, Ti, Zr, W, V, Hf, Mo, Co, Cr, Ni, Ir, Re, and Ru.

16. The method according to claim 11, characterized in that the first metal is ground into the first metal powder with a first powder particle size of between 10 μm and 0.1 μm and/or the second metal is ground into the second metal powder with a second powder particle size of between 10 μm and 0.1 μm.

* * * * *